US008137525B1

(12) United States Patent
Harreld et al.

(10) Patent No.: US 8,137,525 B1
(45) Date of Patent: Mar. 20, 2012

(54) COLLOIDAL SPHERE TEMPLATES AND SPHERE-TEMPLATED POROUS MATERIALS

(75) Inventors: John H. Harreld, Santa Barbara, CA (US); Galen D. Stucky, Goleta, CA (US); Nathan L. Mitchell, Santa Barbara, CA (US); Jeff S. Sakamoto, Arcadia, CA (US)

(73) Assignee: The Regents of the University of California, Oakland, CA (US)

( * ) Notice: Subject to any disclaimer, the term of this patent is extended or adjusted under 35 U.S.C. 154(b) by 2003 days.

(21) Appl. No.: 10/341,671

(22) Filed: Jan. 13, 2003

(51) Int. Cl.
*C25D 1/08* (2006.01)

(52) U.S. Cl. ..... 205/75; 205/159; 205/162; 205/164; 205/238; 205/239; 205/247; 205/252; 205/300

(58) Field of Classification Search ..... 205/70, 205/75, 159, 162, 164, 238, 239, 247, 252, 205/300
See application file for complete search history.

(56) References Cited

U.S. PATENT DOCUMENTS 6,409,907 B1 6/2002 Braun et al.

OTHER PUBLICATIONS

Attard, G.S. et al. "Mesoporous Platinum Films from Lyotropic Liquid Crystalline Phases," *Science* 278: 838-840 (1997).
Bartlett, P.N. et al. "Electrochemical deopsition of macroporous platinum, palladium and cobalt films using polystyrene latex sphere templates," *Chem. Commun*. 1671-1672 (2000).
Bartlett, P.N. et al. "The Electrochemical Deposition of Nanostructured Cobalt Films from Lyotropic Liquid Crystalline Media," *The Journal of the Electrochemical Society* 148 :C119-C123 (2001).
Braun, P.V. et al. "Electrochemically grown photonic crystals," *Nature* 402:603-604 (1999).
Cassagneau, T. et al. "Semiconducting Polymer Inverse Opals Prepared by Electropolymerization," *Adv. Mater*. 14:34-38 (2002).
Crosnier, O. et al "Influence of particle size and matrx in "metal" anodes for Li-ion cells," *Journal of Power Sources* 97-98:189-190 (2001).
Egashira, M. et al. "Properties of containing Sn nanoparticles activated carbon fiber for a negative electrode in lithium batteries," *Journal of Power Sources* 107:56-60 (2002).
Elliott, J.M. et al. "Nanostructured Platinum ($H_I$-ePt) Films: Effects of Electrodeposition Conditions on Film Properties." *Chem. Mater*. 11:3602-3609 (1999).
Fung, Y.S. et al. "Electrodeposited Tin Coating as Negative Electrode Material for Lithium-Ion Battery in Room Temperature Molten Salt." *Journal of The Electrochemical Society*.
Kim, D. G. et al. "Nanosized Sn-Cu-B alloy anode prepared by chemical reduction for secondary lithium batteries." *Journal of Power Sources* 104:221-225 (2002).
Li. H. et al. "Nano-alloy anode for lithium ion batteries." *Solid State Ionics* 148:247-258 (2002).
Li, N. et al. "Nanomaterial-based Li-ion battery electrodes," *Journal of Power Sources* 97-98:240-243 (2001).
Miguez, H. et al. "Germanium FCC Structure from a Colloidal Crystal Template," 16:4405-4408 (2000).

(Continued)

*Primary Examiner* — Arun S Phasge
(74) *Attorney, Agent, or Firm* — Berliner & Associates

(57) ABSTRACT

A method of making colloidal sphere templates and the sphere-templated porous materials made from the templates. The templated porous materials or thin films comprise micron and submicron-scaled spheres in ordered, disordered, or partially ordered arrays. The invention is useful in the synthesis of submicron porous, metallic tin-based and other high capacity anode materials with controlled pore structures for application in rechargeable lithium-ion batteries. The expected benefits of the resulting nanostructured metal films include a large increase in lithium storage capacity, rate capability, and improved stability with electrochemical cycling.

22 Claims, 10 Drawing Sheets

OTHER PUBLICATIONS

Piraux, L. et al. "Arrrays of nanowires of magnetic metals and multilayers: Perpendicular GMR and magnetic properties," *Journal of Magnetism and Magnetic Materials* 175:127-136 (1997).
Schwarzacher, W. et al. "Metal nanostructures prepared by template electrodeposition," *Journal of Magnetism and Magnetic Materials* 198-199:185-190 (1999).
Sumida, T. et al. "Electrochemical preparation of macroporous polypyrrole films with regular arrays of interconnected spherical voids," *Chem. Commun*. 1613-1614 (2000).
Tamura, N. et al. "Study on the anode behavior of Sn and Sn-Cu alloy thin-film electrodes," *Journal of Power Sources* 107:48-55 (2002).
van Vugt, L.K. et al. "Macroporous germanium by electrochemical deposition," *Chem. Commun*. 2054-2055 (2002).
Wang, G.X. et al. "Innovative nanosize lithium storage alloys with silica as active centre," *Journal of Power Sources* 88:278-281 (2000).
Whitehead, A.H. et al. "Nanostructured tin for use as a negative electrode material in Li-ion batteries," *Journal of Power Sources* 81-82:33-38 (1999).
Winter, M. et al. "Electrochemical lithiation of tin and tin-based intermetallics and composites," *Electrochimica Acta* 45:31-50 (1999).
Winter, M. et al. "Insertion Electrode Materials for Rechargeable Lithium Batteries," *Adv. Mater*. 10:725-763 (1998).
Wolfenstine, J. et al, "Nano-scale $Cu_6Sn_5$ anodes." *Journal of Power Sources* 109:230-233 (2002).
Xu, L. et al. "Electrodeposited nickel and gold nanoscale metal meshes with potentially interesting photonic properties," *Chem. Commun*. 997-998 (2000).
Yang, J. et al. "Small particle size multiphase Li-alloy anodes for lithium-ion-batteries," *Solid State Ionics* 90:281-287 (1996).
Yoshimoto, S. et al. "Direct Observation of Structural Change Induced by Redox Reaction of Bis(2-anthraquinyl) Disulfide Self-Assembled Monolayer on Au() 100—(1×1) by in Situ High-Resolution Scanning Tunneling Microscopy," *Langmuir* 16(10):4399-4404 (2000).

COLLOIDAL SPHERE TEMPLATES AND SPHERE-TEMPLATED POROUS MATERIALS

BACKGROUND OF THE INVENTION

Description of the Related Art

Lithium-Ion Anode Materials

The commercial requirements for low cost, safety, and high energy have driven the development of anode materials for lithium batteries (See references 1-8). Lithium metal itself has an exceptionally high specific capacity and provides the minimum anode potential of 0 V vs. Li/Li+. However, several reliability and safety issues limit its application in rechargeable battery systems, including the growth of dendrites that cause short circuits. Furthermore, lithium metal electrodes require a four-fold excess of metal for reversibility (See references 7-8). Table 1 shows the performance comparison of candidate lithium-ion anode materials relative to lithium metal (* theoretically calculated values; 64 volume % from randomly packed spherical pores). The lithium-ion anode materials show a theoretical reversible specific capacity that is a quarter that of the primary capacity of lithium metal, since it should be based on $Li_xLi_3$ instead of $Li_x$ (where x=0-1 during cycling).

TABLE 1

| Material | Reversible Capacity (mAh/g) | Irreversible Capacity (mAh/g) | Volumetric Capacity (mAh/cm$^3$) | See Reference |
|---|---|---|---|---|
| Li metal (primary only) | 3862 * | n/a | 2047 * | |
| $Li_xLi_3$ | 965 * | 0 * | 512 * | 7 |
| Graphitic C | 372 * | 33 | 837 * | 7 |
| Polyacenic C | 530 | about 220 | not reported | 11 |
| $SnO_2$ | 782 * | 796 * | 5646 * | |
| SnO | 876 * | 398 * | 5440 * | |
| $1Sn_2Fe:3SnFe_3C$ | about 200 | about 35 | about 1700 | 36 |
| $4SnO:1B_2O_3:1P_2O_5$ ("TCO") | 650 | 380 | 2200 | 12 |
| metallic Sn → $Li_{4.4}Sn$ | 991 * | 0 * | 7200 * | |
| Porous metallic Sn | 991 * | 0 * | 2590 * | |

The first systematic study of the electrochemical lithiation of several metals from organic solvent solutions has been disclosed (See reference 9). The resulting lithium-metal intermetallic alloy systems showed great promise as anode materials for rechargeable lithium ion batteries, since they (1) exhibited high capacities for lithium storage, and (2) contributed a greater margin of safety against the formation of lithium metal dendrites (i.e. electrode potential above 0 V vs. $Li/Li^+$). Research in this area diminished significantly when it was learned that the lithium-metal alloy systems had very poor cycling characteristics. Specifically, the density of lithium-metal alloys decreased dramatically as the lithium content is increased. The corresponding volume expansion (e.g. 259% for $Li_{4.4}Sn$, relative to Sn) and contraction that occurred during electrochemical cycling caused fragmentation of the electrode and loss of anode material.

The next stage of lithium anode development began in 1990 when Sony Corp. developed and commercialized graphite anodes with specific capacity and exceptional cycling stability (See reference 10). The structure of graphite allows lithium storage between its hexagonal sheets up to a stoichiometry of 1 Li/C6 (corresponding to a specific capacity of 372 mAh/g of carbon). Additionally, polyacenic carbons have a greater interlayer spacing than graphite and have been shown to intercalate as much as 1 $Li/C_{2.2}$ with a corresponding increase in specific capacity (See reference 11). However, due to the formation of passivation layers during initial charging, carbons used in commercially manufactured lithium cells exhibit reversible capacities (339 mAh/g) of substantially less than 1 $LiC_6$. (See reference 7).

Interest in lithium-metal alloy systems was largely renewed when Fuji Photo Film and Fujifilm Celltec introduced an anode material composed of the amorphous tin-based composite oxide (TCO) $Sn_2BPO_6$. (see reference 12). Later studies revealed that the active material was actually made up of nanoscale domains of electrochemically reduced tin metal situated in an inactive matrix of $B_2O_3$, $P_2O_5$ and $Li_2O$ (See reference 13). Since then, there have been three principal approaches to accommodate density changes of lithium-metal systems during electrochemical cycling: (1) active, (2) active-active composite materials with very small particle size morphology, i.e., micron or submicron, and (3) active-inactive composite materials.

Small particles of active material allow the lithium to exchange between the electrode and electrolyte much more readily, due to high interfacial areas and short diffusion distances. Other advantages of small particle sizes are that there is less absolute size increase and less opportunity for phase separation and mechanical strains that may arise from density mismatches. Improvements in cycling performance have been clearly demonstrated by limiting the active domains to small size scales in the cases of active (See references 14-20), active-active composite (See references 20-25), and active-inactive composite materials (See references 14, 18, 26-34).

Active-inactive composites are designed to follow the "inert matrix" model, in which the electrochemically active material is contained in a mechanically stable supporting matrix of electrochemically inactive material. Prominent members of this class of anodes include tin oxide based materials (See references 12, 27, 35), $Sn_2Fe/SnFe_3C$ mixtures (See reference 36), and alloys of AB where A is a metal that alloys electrochemically with Li (e.g., Mg, Ca, Al, Si, Ge, Sn, Pb, As, Sb, Bi, Pt, Ag, Au, Zn, Cd, and Hg) and B is inert (e.g. Cu, Ni, Ti, and Fe) (See references 7, 9). If the domain size and morphology of the active material are optimized, there may not be a need for the use of active-inactive composites. An ideal anode material has been described as being composed of a nanoporous or mesoporous tin metal network without oxides or other inactive binder so that the reversible specific capacity is maximized while the porosity provides space for the "swelling" of the nanostructured metal (See references 15, 27).

Sphere Templated Materials Syntheses

The application of sacrificial templates to electrochemical deposition opens the door to a new class of nanoscaled metallic materials with many possible incarnations. The fabrication of metal nanofibers through a porous inorganic membrane (See reference 37) and a track-etched polymer film (See reference 38) has been disclosed. The deposition of mesoporous metal films using liquid crystal phases (See references 15, 39-41) and self-assembled arrays of colloidal spheres (See references 42-45) has also been disclosed. Electrochemical deposition in the presence of polymer or silica microspheres has been shown to be highly effective in producing well-ordered sub-micron and mesoscopic structures of cadmium selenide, cadmium sulfide, platinum, palladium, cobalt, and germanium (See references 42, 44, 45).

Colloidal spheres of silica or various polymers are simple to synthesize and are commercially available in sizes as low as tens of nanometers in diameter. These templates are stable in aqueous electrolyte environments and, if desired, self-assembled, close-packed, crystalline arrays can be obtained (See references 46-49). Once a solid material is synthesized within the interstitial volume between the spheres, the templating polymer is removed by dissolution into a solvent or by thermal decomposition. The use of three-dimensional crystalline arrays of colloidal particles for the synthesis of porous silica (See reference 48), has been extended to the synthesis of many mesoporous and macroporous materials. Examples include porous polyurethane membranes (See reference 50) and several oxides (See references 49, 51-55).

SUMMARY OF THE INVENTION

The present invention describes thin films and a method of making the thin films comprising micron and submicron-scaled spheres in ordered, disordered, or partially ordered arrays. These films exhibit an exceptionally low degree of cracking and can thus be used as sacrificial templates in the preparation of thin films of porous materials synthesized within the interstices between the spheres (FIG. 1).

The present invention is useful in the synthesis of submicron porous, metallic tin-based and other high capacity anode materials with controlled pore structures for application in rechargeable lithium-ion batteries. The expected benefits of the resulting nanostructured metal films include a large increase in lithium storage capacity, rate capability, and improved stability with electrochemical cycling as compared with the existing alternatives. The various sources of capacity loss (electrode fragmentation, irreversible formation of $Li_2O$, electrode surface passivation, electronic isolation of active material, etc.) will be minimized, accommodated, or entirely avoided by the disclosed material and method of the present invention, in order to maximize the energy density of portable power supplies. Furthermore, the porous metal fabrication methods of the present invention can be extended to other electrochemical and energy storage material applications.

One embodiment of the present invention is a process for colloidal sphere-templated electrodeposition of a porous metal structure, comprising: a) providing an electrode substrate; b) applying a dispersion formed of colloidal spheres in a liquid phase onto the surface of the substrate; c) removing the liquid phase to form a sacrificial template comprising an array of close packed colloidal spheres defining an interstitial volume; d) electrodepositing a metal plating solution onto the array to form a metallic replica of the array interstitial volume having a pore distribution corresponding to the spheres; and e) removing the sacrificial template to form said porous metal structure. Another embodiment of the invention includes, after removing the liquid phase to form a sacrificial template, heating the template below the melting point of the colloidal particles.

In another embodiment the colloidal spheres are polystyrene, polymethylmethacrylate, surface-functionalized polymer, or silica. The removal of the liquid phase to form a sacrificial template is preferably done by liquid evaporation or centrifugation. The removal of the sacrificial template to form said porous metal structure is preferably by dissolution with a solvent or an acid.

In yet another embodiment, the metal or metal alloy is Sn, Al, Si, Ge, Pb; Sb—Sn; Cu—Sn; Sb—Cu—Sn; Pb—Sn; Sn—Se; Bi—Pb—Cd—Sn; Al—Sn; Pb—Sn; Co—Sn; Au—Sn; Zn—Sn; Sb—I; Ni—Sn; Al—Mn; Al—Be; or Al—Ni. In yet a further embodiment, the spheres are selected to have a mean diameter within the range of about 10 nm to about 1000 nm, with a deviation from the mean pore diameter of more than about 5%, wherein said pores are connected to each other. In a further embodiment, the present invention discloses a template and a porous metal film made by the previously described process.

In yet a further embodiment, the present invention discloses a porous metal or metal oxide film, a porous metal film, a porous electrode film, a porous Sn film, having pores of mean diameter within the range of about 10 nm to about 1000 nm, with a deviation from the mean of more than about 5%, wherein said pores are connected to each other.

The templates and porous films and the methods for making them described herein make possible the production of superior electrode technologies for lithium ion batteries including anodes that outperform graphite and TCO materials in terms of reversible capacity, rate capability, and cycling efficiency. The inherent specific capacity of tin metal for lithium storage is a factor of several times higher than that of graphitic carbon (Table 1). Furthermore, reversibility is enhanced by the use of metallic tin instead of tin oxide-based material systems because the irreversible formation of $Li_2O$ is avoided. Charge and discharge rates and cycling efficiency are improved by the sub-micron scaled morphology of the metal network. The size of the original spheres dictate several important structural parameters of the electrode, especially (a) the amount of interfacial area per volume between the electrode and the electrolyte and (b) the size scale of the metal skeleton (i.e. the maximum distance from any interior point in the metal to the surface).

Creating very small metal structures that alloy electrochemically with lithium minimizes the absolute size changes during swelling (i.e., due to a typically large decrease in density from the base metal to the alloy), thus reducing the tendency towards material fracture. Another benefit of creating very small metal structures that alloy electrochemically with lithium is that the distance over which the diffusion of lithium must occur during charging and discharging of a lithium ion battery is also minimized. If lithium diffusion distances are high, a concentration gradient will develop and several lithium-metal intermetallic phases will be present simultaneously. Mechanical strains and density differences between these phase-separated domains contribute to the "pulverization" or "fragmentation" problem that plagues metal anodes in lithium-ion batteries and causes the loss of electrochemical contact between anode material and the remaining electrode. By limiting diffusion distances to several nanometers or tens of nanometers, lithium can be made to leave the alloy more homogeneously, avoiding the deleterious effects of phase separation.

Small adaptations to the template formation and material synthesis method can be made to create micron and submicron-porous films comprising many other material systems and templated by wide areas of crack free sphere assemblies. The fabrication of porous films for many applications does not require an ordered lattice of spherical pores. For example, high surface area, energy-storage electrodes achieve no significant benefit from ordered porosity since controlled average pore size and pore arrangement is sufficient. Anisotropic shrinkage occurs during the final solvent evaporation from polymer spheres packed with crystalline ordering. The shrinking lattice of spheres results in cracks opening on close-packed cleavage planes as is observed in well-ordered sphere arrays of more than a few sphere diameters in thickness (FIGS. 2*a-b*). Especially with regard to the electrochemical fabrication of good quality porous films, it is important to have a crack-free template film so that bulk non-porous material is not formed preferentially in the cracks instead of within the interstitial volume of the spheres.

The present invention describes methods for the assembly of sphere films, which make wide areas of crack free template by forgoing the objective of perfectly ordered spheres. Thus, cracking of dried films can be dramatically decreased by intentionally introducing disorder in the arrangement of the sphere packing.

The present invention also provides: 1) The creation of metallic tin or tin-based alloy films containing an interconnected network of micron or submicron sized pores derived from electrochemical deposition though a sacrificial template of silica or polymer spheres; 2) The intentional use of micron or submicron sphere populations with naturally occurring or artificially imposed size polydispersity in order to create disordered (or partially disordered) crack-free sacrificial template films over relatively wide areas compared to well-ordered films obtained from sphere populations having low polydispersity; 3) The intentional use of mixtures of micron or submicron sphere populations in order to create artificially imposed multi-modal size distributions in order to create disordered (or partially disordered) crack-free sacrificial template films over relatively wide areas compared to well-ordered films obtained from sphere populations having low polydispersity; 4) The application of so-obtained porous tin or tin-based alloy films as the lithium storage anode in a lithium-ion secondary (rechargeable) battery in order to obtain improvements in (a) specific charge capacity and charge/discharge rate capability compared with currently available commercial anodes and (b) cycling efficiency compared with bulk tin metal or tin-based alloys; and 5) The ability to engineer the network structure of the porous metal electrode for optimal mechanical and electrochemical performance by simply changing the average sphere size(s), polydispersity, and relative weight fractions (in the case of multimodal distributions) contained within the sacrificial template.

BRIEF DESCRIPTION OF THE DRAWINGS

(FIG. 7A) 60 nm spheres, 0.10 wt. % dispersion; (FIGS. 7B and C) 60 nm spheres, 0.05 wt. % dispersion; (FIG. 7D) 1:1 ratio of 260:110 nm spheres, 0.20 wt. % dispersion; (FIG. 7E) 1:1 ratio of 260:110 nm spheres, 0.10 wt. % dispersion (FIG. 7F) a higher magnification SEM image of FIG. 7*e;*

(FIG. 9*a*) top-view and (FIG. 9*b*) cross-sectional view; (FIG. 10*c*) cross-sectional images of tin film grown for about 2 minutes (FIG. 10*d*) a lower magnification SEM image of FIG. 10*c*.

DETAILED DESCRIPTION OF THE INVENTION

Figure 1:
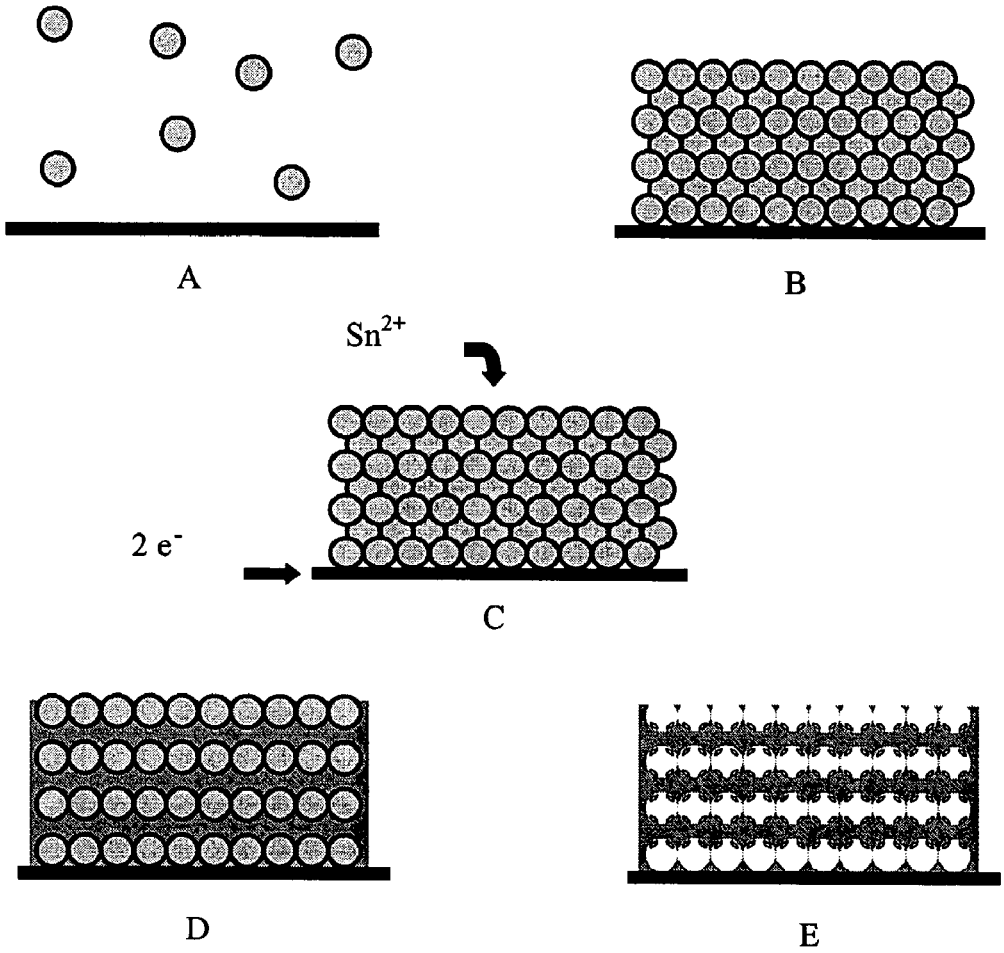
FIG. 1 is a schematic representation of one embodiment of a process for colloidal sphere-templated electrodeposition of sub-micron porous metal nanostructures of the present invention.

Disordered assemblies and partially crystalline arrays of submicron spheres of various compositions (e.g., polystyrene, polymethylmethacrylate, surface-functionalized polymer, and silica) are used as a sacrificial template for the electrochemical deposition of porous, nanostructured tin metal. The nanoscaled tin structure resulting from electrochemical deposition in the presence of these random or ordered close-packed colloidal spheres is a metallic replica of the interstitial volume. Once the metal structure is established, the template is removed either by a suitable organic solvent in the case of polymer spheres or by dilute acid, e.g., hydrofluoric acid in the case of silica spheres. A schematic of the synthesis process is shown in FIG. 1. Specifically, FIG. 1 shows A) the placement of colloidal sphere dispersion above an electrode substrate; B) the assembly of spheres via liquid evaporation or centrifugation; C) the addition of a metal plating solution; D) the controlled electrodeposition of metal through the void space of the sphere assembly; and E) the dissolution of sphere templates with a solvent or acid. The ordered arrangement of the spheres shown in the schematic of FIG. 1 is optional and often completely unnecessary or undesired.

In addition to the ability to select the average pore size, selecting the pore arrangement will also dictate the performance of the solid network during solute diffusion (e.g. Li from $Li_xSn$ phases) and the resulting swelling. Thus, the continual access to pore surface area and the overall mechanical response of the bulk material to swelling and contraction (e.g., as due to lithium insertion and extraction, respectively) is expected to be dependent on the network configuration. Optional configurations of pore arrangement include those that comprise either amorphous domains, any of the various possible ratios of crystalline to amorphous domains (e.g., 1-99%), or entirely crystalline domains.

The fabricated template films comprising entirely amorphous or partially amorphous domains resulted in a dramatic decrease in cracking (much fewer cracks per area) and was possible by intentionally disrupting the spontaneous crystalline self-assembly observed in systems of monodisperse sized spheres. Crystalline order of packing spheres was broken by the use of spheres with a sufficiently broad pore size distribution derived either naturally (resulting from the synthesis of the colloidal spheres) or artificially (resulting from selected mixtures of sphere populations with each having a different average size).

Figure 2A:
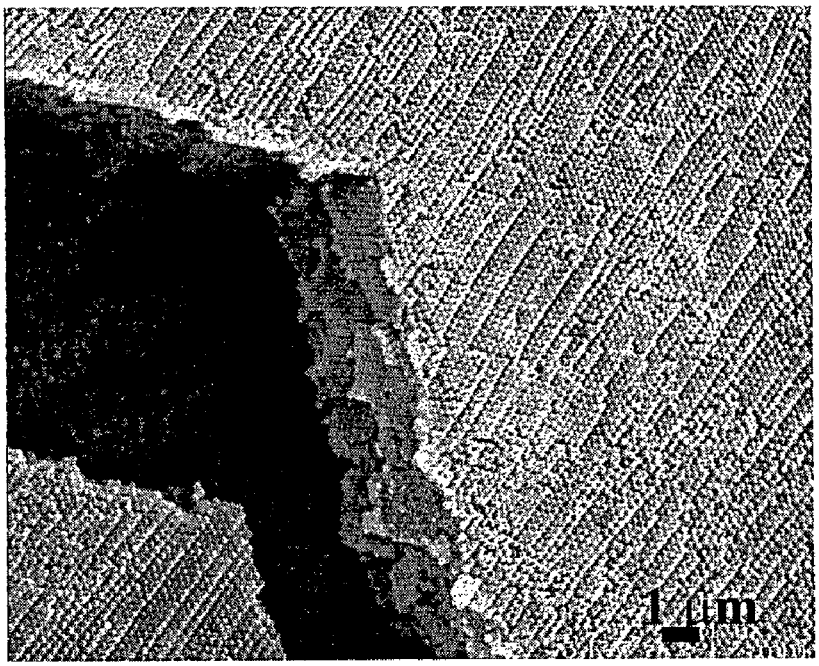
FIGS. 2*a-b* are scanning electron microscope (SEM) images of an embodiment of the present invention showing the cracked surface of a well-ordered close-packed crystalline assembly of 250 nm polystyrene (PS) spheres, (FIG. 2*a*) shows highly ordered spheres continuously through the thickness of the film, and (FIG. 2*b*) shows the overall concentration of surface cracks.
Figure 2B:
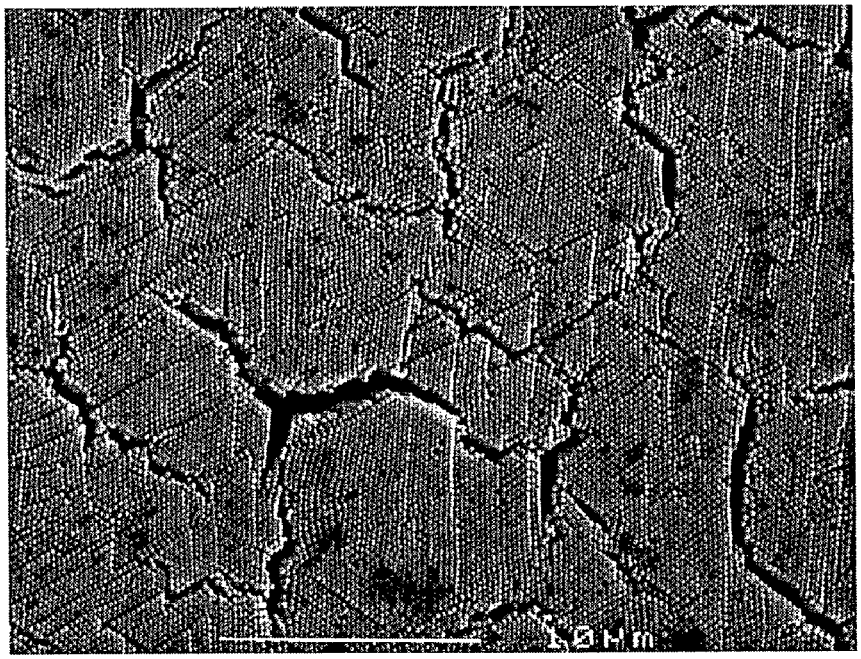
Figure 3A:
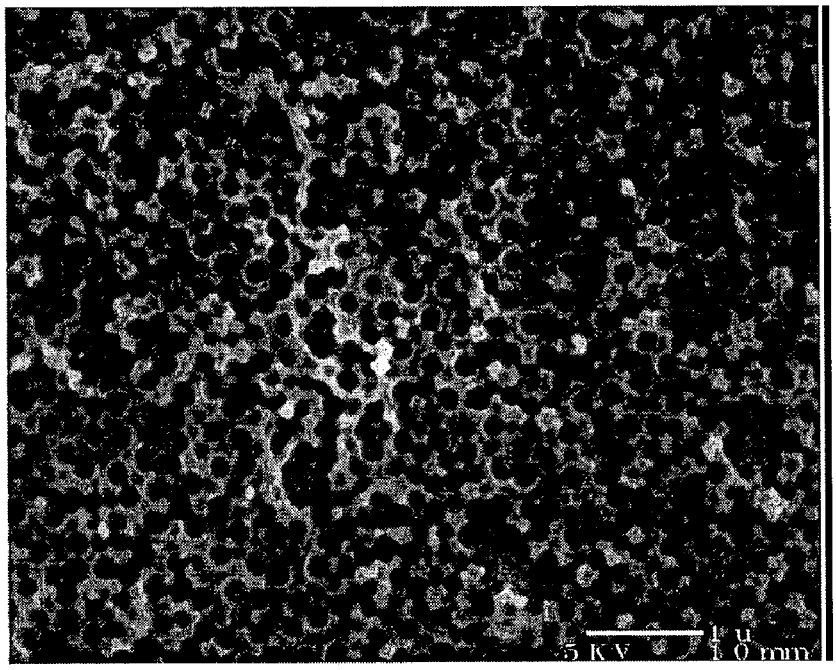
FIGS. 3*a-b* are SEM images of an embodiment of the present invention showing (FIG. 3*a*) a submicron porous tin surface after dissolution of polystyrene spheres and (FIG. 3*b*) a lower magnification SEM image.
Figure 3B:
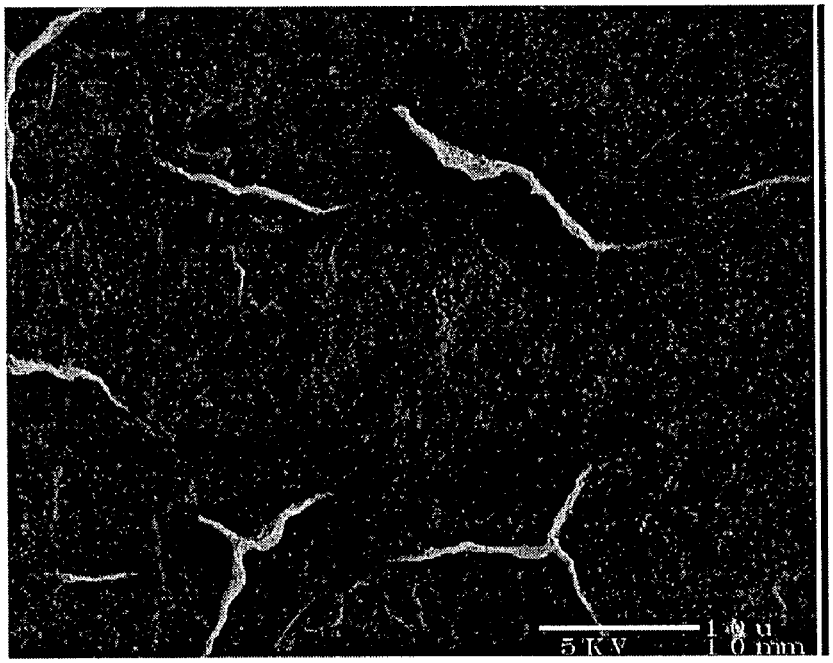
Figure 4:
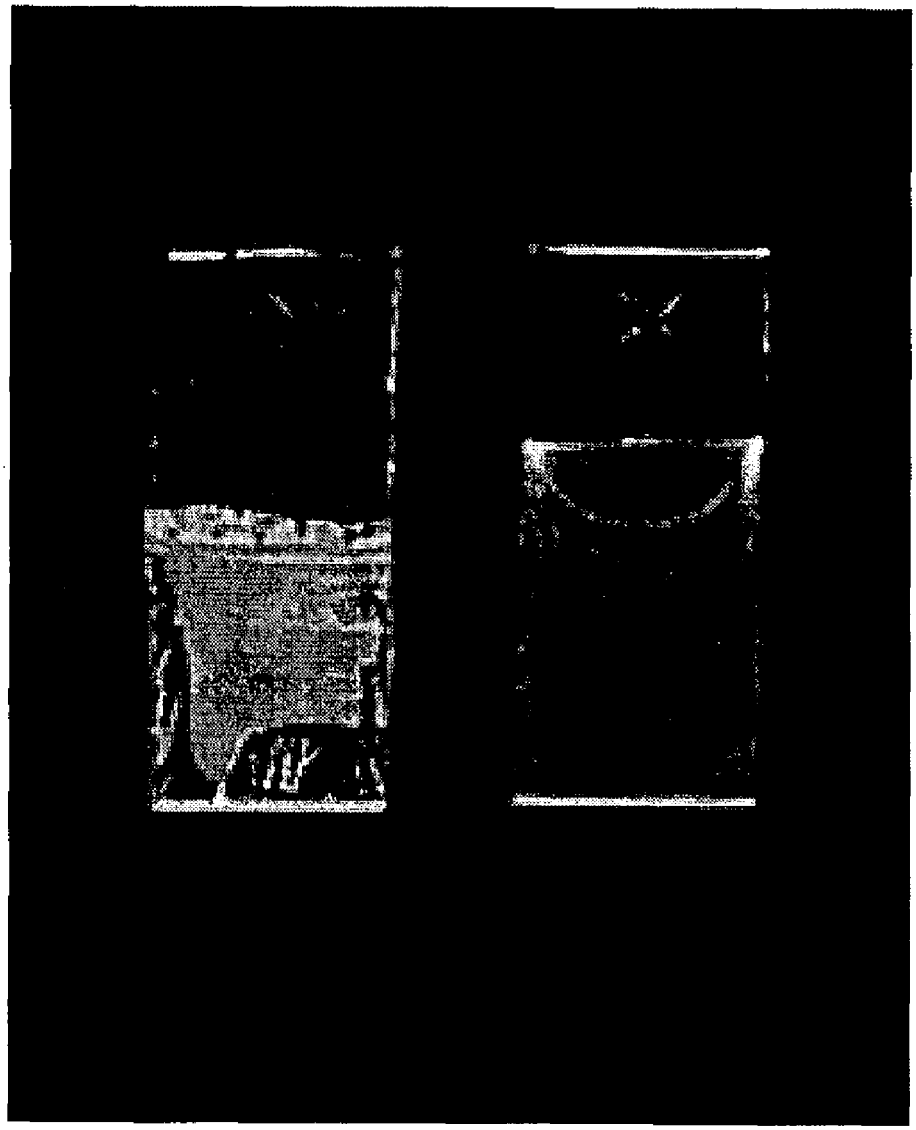
FIG. 4 shows an iridescent template of an embodiment of the present invention comprising (left) crystalline close-packed spheres and (right) translucent template of disordered spheres.

Crystalline arrays of PS spheres have been disclosed with uniform and controlled thickness by using a vertical deposition process involving the evaporation of aqueous or alcoholic sphere dispersions (See reference 44). These films were unsuitable for templating electrodeposited porous metal films since they characteristically contained cracks (FIGS. 2*a-b*). The present invention demonstrated that bulk tin preferentially electrodeposits within these cracks rather than in the interstices between the spheres. FIG. 3*a* shows a submicron porous tin surface after dissolution of polystyrene spheres and (FIG. 3*b*) a lower magnification SEM image, shows that relatively tall domains of non-porous bulk tin, which filled the cracks in the template, now border the porous tin areas. Furthermore, the present invention describes a general correlation between the degree of order in the sphere-packing and the tendency towards crack formation (FIG. 4).

The present invention overcame the problems associated with cracked templates in two complementary ways. The first way was to use spheres having a high standard deviation in sphere diameter (more than about 5%, or more than about 10-15%) yielding disordered crack-free templates over large areas (FIG. 4). The substrates of FIG. 4 are 1 cm wide ITO-coated glass. The second way was to identify and work below the threshold thickness for crack formation. Even disordered films will crack if too thick. This parameter was controlled by carefully setting the concentration of the PS sphere dispersions. The present invention described methods for crack-free disordered templates using sphere sizes in the range of about 260 nm to 60 nm.

Figure 5A:
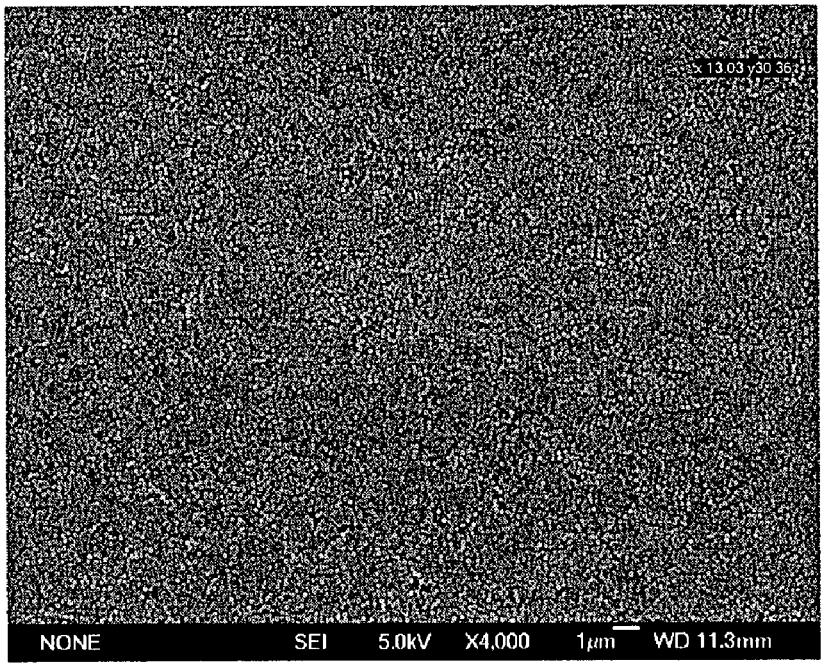
FIGS. 5*a-b* are SEM images of an embodiment of the present invention showing (FIG. 5*a*) a crack-free disordered template film made from 60 nm diameter polystyrene spheres and (FIG. 5*b*) resulting thin film of submicron porous tin after the electrodeposition process.
Figure 5B:
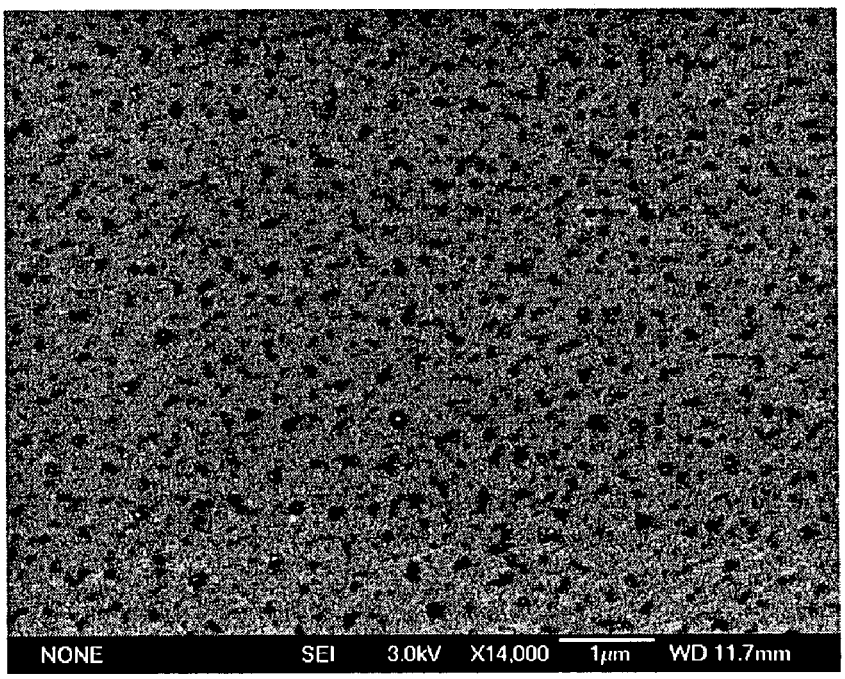

The present invention described electrodeposition of tin using these new templates, from which the dissolution of the polystyrene template yielded a disordered porous tin structure in certain regions of the film (FIGS. 5*a-b*). FIGS. 5*a-b* are SEM images of an embodiment of the present invention showing (FIG. 5*a*) a crack-free disordered template film made from 60 nm diameter polystyrene spheres and (FIG. 5*b*) resulting thin film of submicron porous tin after the electrodeposition process. A disordered porous metal structure exhibits all of the same electrode performance benefits related to high surface area and small domain size of active material. Furthermore, the theoretical packing density of disordered spheres is less than that of perfectly close-packed spheres, so the volume fraction occupied by the interstitial space will be greater. Thus, the metal deposited in this space will occupy greater than 26% of the total electrode volume, and the volumetric lithium storage capacity will be increased likewise.

Figure 6A:
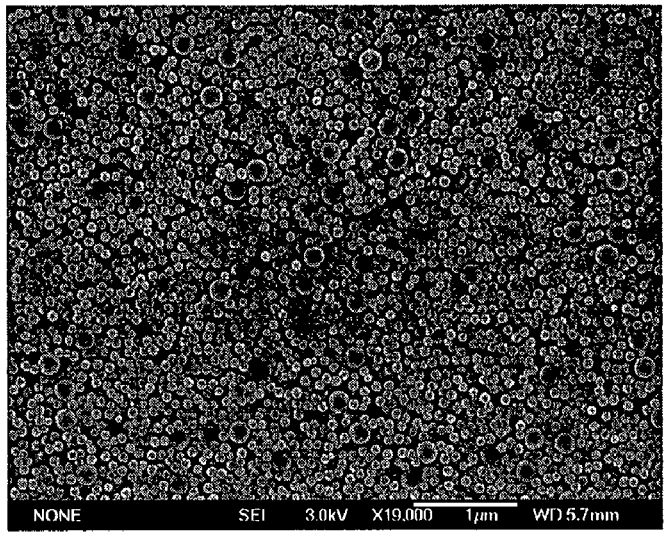
FIGS. 6*a-c* are SEM images of an embodiment of the present invention showing crack-free PS sphere templates having varied arrangements obtained by mixing different ratios of 250 and 110 nm spheres; Mass ratios of 250 nm:110 nm spheres are (FIG. 6*a*) 1:1, (FIG. 6*b*) 1:4, and (FIG. 6*c*) 1:49.
Figure 6B:
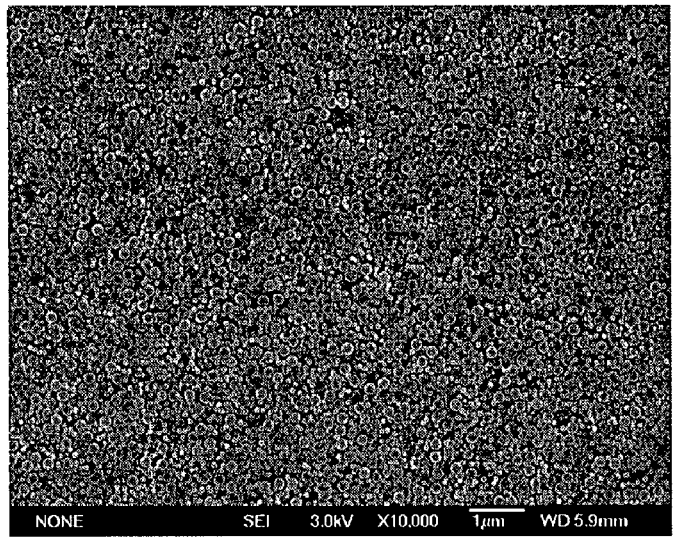
Figure 6C:
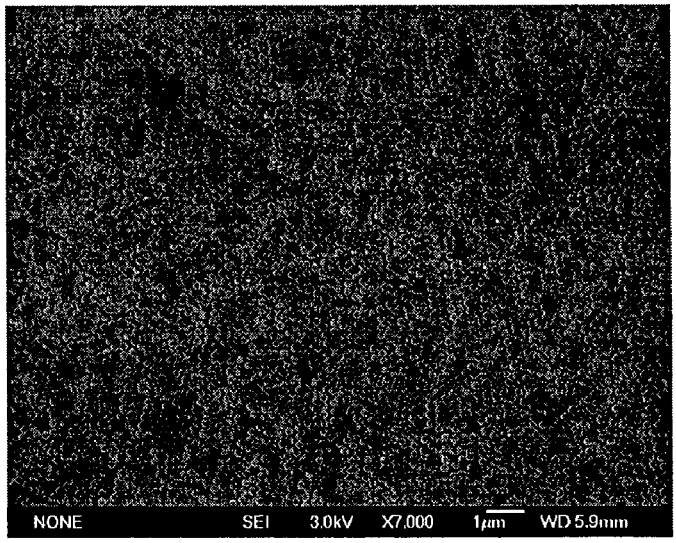
Figure 7:
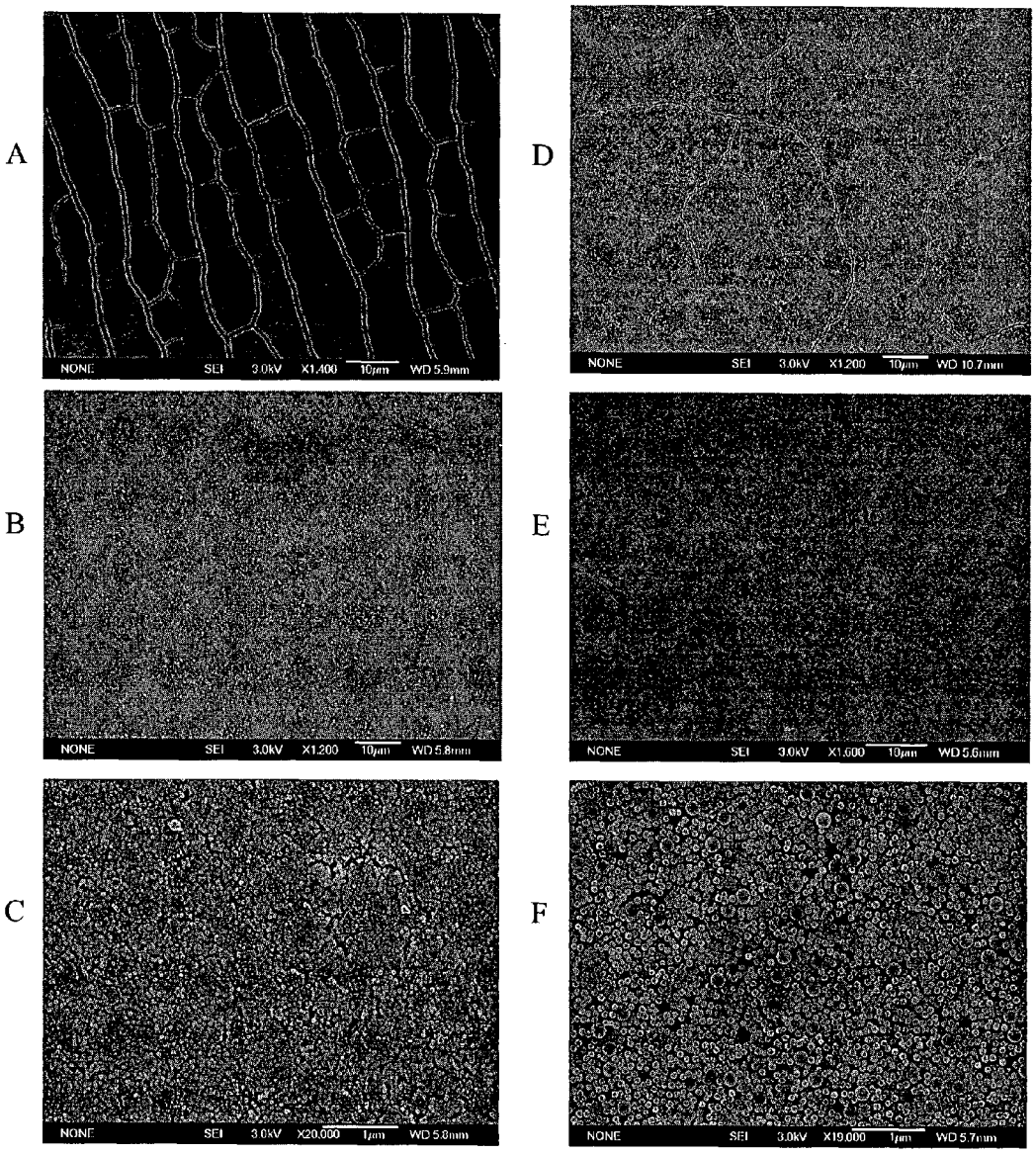
FIGS. 7*a-f* are SEM images of an embodiment of the present invention showing the critical thickness for cracking using the vertical deposition method with polystyrene spheres.

The mixing of two or more populations of differently sized spheres in which the size of each is highly monodisperse creates an "artificial polydispersity" in sphere sizes. The results of this strategy are generally beneficial in avoiding cracked films and depend greatly on the relative sizes, size polydispersity, and relative concentrations of each sphere population. For example, the present invention provides new structures of disordered crack-free film (FIGS. 6*a* and *b*), as well as crack-free films comprising small crystalline domains of the larger sized sphere that are separated by disordered domains and smaller sphere point defects (FIG. 6*c*). The present invention provides systematic control of the structure of suitable templates in several ways in order determine how pore size and arrangement affects the electrochemical cycling behavior of submicron porous tin anodes.

The synthesis of porous tin metal anodes for a secondary (rechargeable) lithium-ion battery begins with the formation of a polystyrene sphere template on a conductive substrate, such as: copper foil, indium-tin oxide coated silica glass, platinum-coated glass or copper foil. Depending on the application, any electronically conductive substrate may be used as long as it is chemically and electrochemically stable in the tin deposition bath under the voltage conditions required for tin plating. When template-coated platinum or gold surfaces are used as the working electrodes, the formation of tiny gas bubbles tends to disrupt the adhesion at the template-substrate interface. The present invention eliminated or sufficiently reduced this problem by laying down a very thin layer (e.g., about 10-700 nm thickness) of tin metal onto the substrate, prior to assembling the sphere template film. This effectively insulates the tin plating-bath electrolyte from the catalytic platinum surface and avoids bubble formation.

There are many published methods of assembling colloidal spheres into a film layer. Two alternate methods of assembling colloidal spheres into a film layer were selected for their convenience and simplicity. Other methods of assembling colloidal spheres into a film layer can be substituted by one skilled in the art. The first method is to immerse the substrate vertically in an aqueous-alcoholic dispersion of colloidal-sized (e.g., about 10-1000 nm diameter) polymer or silica spheres and allow the dispersion to dry past the end of the substrate (See reference 44). The other method is to simply "paint" the concentrated dispersion onto the substrate (e.g., using a pipette) and allow the liquid phase to dry. In each case, capillary forces between the particles will cause them to assemble into a crystalline, amorphous, or mixed crystalline-amorphous arranged film. As described above, the sphere arrangement depends on the size distribution of the sphere population used.

Once the film is dry the spheres may optionally be slightly sintered together by heating the template below the melting point of the material composing the spheres (e.g., 500 C for silica glass or 90 C for polystyrene). This procedure serves to assure that the spheres will interconnect and provide windows between the pores of templated materials; however, this interconnected pore structure is often obtained without heat-treating the template.

Once prepared, the template film was immersed in a suitable tin or tin alloy electroplating solution with proper counter and reference electrodes in a suitable configuration known to those versed in the art of high-quality metal electroplating. Either potentiostatic metal deposition or any manner of pulsed potential profile may be used to electroplate the metal throughout the template. Preferably the plating process is stopped before the thickness of the metal film reaches the top of the sphere template. If metal plating is continued beyond this point, non-porous bulk metal will be formed and the template may be physically isolated from being extracted.

The metal-sphere composite was then rinsed off in an appropriate wash solution (e.g. deionized water or alkyl alcohol) and immersed in a solution that dissolved away the sphere template (dilute hydrofluoric acid for silica spheres, or organic solvents such as toluene, tetrahydrofuran or acetone for polymer spheres). After thoroughly rinsing and drying, thermally and or by using negative pressure, the porous metal films are ready to be interfaced with a suitable lithium-ion containing electrolyte and a cathode material, as part of a lithium-ion secondary battery assembly process.

EXAMPLE 1

Vertical Deposition Template Formation—Single Modal Size Distribution

Conductive substrates for use in vertical deposition experiments were prepared by thoroughly cleaning laboratory glass slides (2×3 inches), then depositing 100 Å of Ti followed by 500 Å of Pt or Au using electron beam evaporation. Both Pt and Au were used in different samples. A plastic mask was fashioned out of a strip of Teflon, such that only certain areas of the slide were exposed to the conductive metal. These slides were cut into smaller strips for use as substrates. Strips of indium tin oxide (ITO) coated glass, which were cut to about 1 cm wide, were also used as substrates after cleaning with isopropanol, dilute HCl, and deionized (DI) water.

Vertical deposition was carried out by suspending substrates in vials containing dispersions of polystyrene spheres and allowing the solvent to evaporate. Methanol having a concentration of about 98-100 volume % was used as the solvent to prepare dispersions containing between about 0.13 and 1.0 wt % of 250 nm diameter PS spheres. A glass crystallization dish was used to slow the evaporation rate and to prevent contamination and convection currents. The goal was to determine quantitatively the relationships between concentration and thickness and between thickness and the degree of cracking.

Non-functionalized polystyrene spheres contain negatively charged sulfate groups on the surface due to their synthesis method. Negatively charged polystyrene template may tend to delaminate from an electrode that is also negatively charged during the electrochemical reduction of tin ions. In such a case, deposition of tin metal could occur between the template and the electrode, pushing the template forward with the metal formation. Thus, use of a positively charged PS template that would adhere more strongly with the applied bias during the tin electrodeposition process was described. For this reason, vertical film depositions were also performed using polystyrene microspheres that were functionalized with quaternary ammonium surface groups ($R—N(CH_3)_3^+$). These positively charged spheres flocculated from dispersions diluted with methanol or ethanol, so aqueous dispersions of these spheres, as well as the standard negatively charged spheres were used. Due to the much slower evaporation rates of water compared with methanol, aqueous depositions were carried out at elevated temperatures of about 20-100° C., preferably about 50-80° C. Deposition studies were made using ITO coated glass substrates in aqueous dispersions with sphere concentrations ranging from about 0.05-0.50% w/w, and evaporation temperatures ranging from about 25 to 80° C. Dried films were examined by optical and electron microscopy.

Electron beam evaporated metal substrates offer several advantages over previously used copper foil tape, including: minimal interfacial effects, easily controlled geometry, greater uniformity, and smoothness. Results from polystyrene-film depositions using these substrates were indistinguishable from those using cleaned ITO-coated glass. However, in either case, when negatively charged spheres from methanol dispersions were deposited, the film quality varied significantly. Some samples exhibited iridescence (red transmission, green reflection) which is characteristic of ordered sphere arrays, while others showed no iridescence and uneven coverage of films. Although the iridescent films exhibited a dense network of cracks, it was clear that the film appeared the same on the metallized portion of the substrate and the uncoated glass. This result confirms that the edge between the Pt layer and the glass substrate did not significantly disrupt the structure of the polystyrene template.

Polystyrene films prepared from positively charged spheres appeared quite different from the films acquired from the non-functionalized negatively charged spheres (from methanol or water dispersions). The positively charged films did not exhibit iridescence, but rather appeared hazy white in color. Also, samples from positively charged spheres exhibited much more uniform and smooth coverage than the substrates with negatively charged spheres. FIG. 4 shows a photograph illustrating the difference between the iridescence of the negatively charged sphere films and the uniform haziness of the positively charged sphere films.

Optical and scanning electron microscopy also revealed several differences between films prepared from positive and negative spheres. Both techniques showed that the positively charged templates exhibited less or no cracking compared to those from negative spheres. In addition, SEM showed the positively charged templates to be disordered while the negative templates are close packed into ordered face-centered cubic arrays. Although the difference in assembly behavior was initially thought to be related to the surface charges of the spheres, subsequent SEM examination revealed that the difference is caused by a higher polydispersity of diameters in the positive spheres.

The standard deviation of negatively charged sphere diameters is typically 5%, which is consistent with the well-ordered lattice structures shown in previously reported SEM images. The SEM images of corresponding films showed a disordered assembly of spheres. Additional SEM analyses revealed a large range of sphere sizes present in these templates. Large crack-free areas were observed from these disordered templates. Analysis of optical microscopy images revealed that negatively charged arrays having a low size-polydispersity typically exhibited greater than three times the degree of cracking compared with positively charged sphere arrays having a high size-polydispersity. Moreover, many templates made from positively charged spheres using a variety of assembly conditions (i.e., evaporation temperature and dispersion concentration) exhibited no cracks under optical microscopy from an area of about 1 $cm^2$.

In order to assess the differences between positively charged sphere arrays deposited from different concentrations of sphere dispersions and different temperatures, cross-sectional SEM measurements were also made. By fracturing samples using a diamond-scribe and examining the fractured surface, film thickness was measured. Table 2 shows thickness measurements from cross sectional SEM results from some representative samples. A clear correlation between ordered sphere packing and film cracking was found. Ordered structures inherently possess anisotropy, due to the distinct crystallographic nature of the face-centered cubic close-packed lattice. Since disordered structures are isotropic, shrinkage stresses are distributed uniformly. Also, since the spheres are not completely close-packed there is additional free volume that may accommodate relaxational re-assembly during the final shrinkage of the template that occurs during complete drying.

TABLE 2

| Concentration (w/w %) | Temperature (° C.) | Avg. Thickness (μm) |
|---|---|---|
| 0.5 | 80 | 0.35 |
| 0.2 | 80 | 0.33 |
| 0.2 | 55 | 0.55 |
| 0.2 | 25 | 0.42 |

EXAMPLE 2

Vertical Deposition Template Formation—Multi-Modal Size Distributions

Templates containing a 1:1 mass ratio of about 250:110 nm diameter (negatively charged) polystyrene spheres were prepared from dispersions ranging from about 0.05 to 0.5 wt. %. The thickness, sphere arrangement, and degree of cracking were assessed by SEM. FIGS. 7A-F are SEM images demonstrating the critical thickness for cracking using the vertical deposition method with polystyrene spheres, which was found to lie between about 0.1 and 0.2%, corresponding to a thickness of about 2.2 microns. (FIG. 7A) 60 nm spheres, 0.10 wt. % dispersion; (FIGS. 7B and C) 60 nm spheres, 0.05 wt. % dispersion; (FIG. 7D) 1:1 ratio of 260:110 nm spheres, 0.20 wt. % dispersion; (FIG. 7E) 1:1 ratio of 260:110 nm spheres, 0.10 wt. % dispersion (FIG. 7F) a higher magnification SEM image of FIG. 7*e*.

Figure 8A:
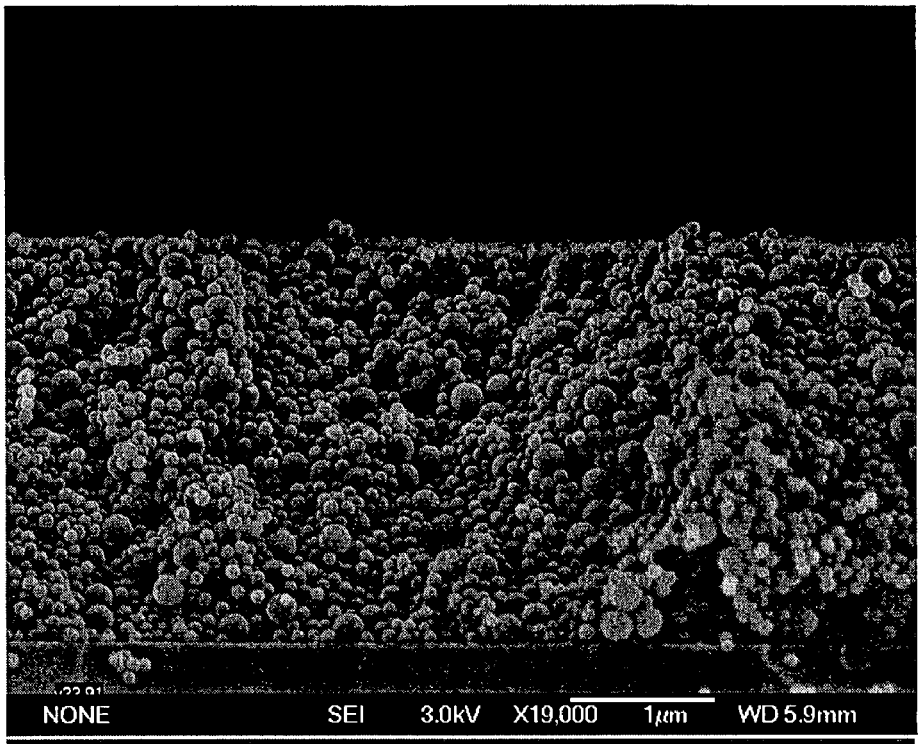
FIGS. 8*a-b* are cross-sectional SEM images of an embodiment of the present invention showing templates (FIG. 8*a*) containing a 1:1 mass ratio of 260:110 nm spheres vertically deposited from a 0.20 wt. % dispersion and (FIG. 8*b*) a higher magnification SEM image.
Figure 8B:
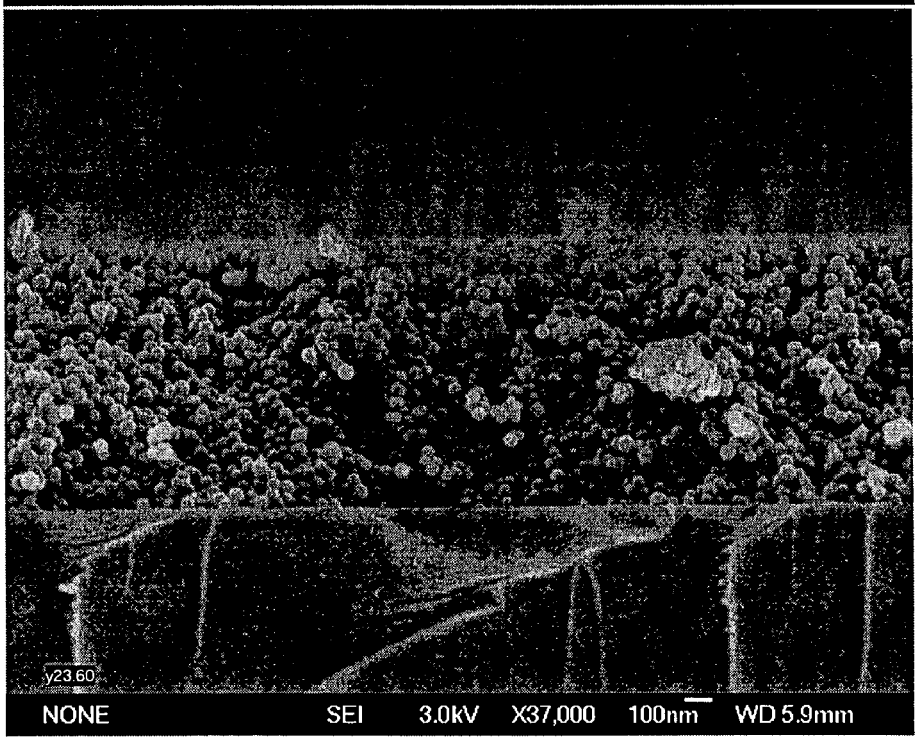

FIGS. 8 *a-b* illustrate a typical cross-section SEM micrograph showing that an interpenetrating network of void space remained in which tin will be deposited. FIGS. 8 *a-b* are cross-sectional SEM images showing templates (FIG. 8*a*) containing a 1:1 mass ratio of 260:110 nm spheres vertically deposited from a 0.20 wt. % dispersion and (FIG. 8*b*) a higher magnification SEM image. In addition to 1:1 mass ratios, the present invention also provided other mixtures of large to small such as 80:20 and 98:2 ratios of about 260:110 nm diameter spheres. Both templates, which were prepared from about 0.2% total concentration, exhibited no cracking, and each of their thickness was similar to the sample from the 1:1 ratio, 0.2% dispersion.

The sample prepared with a 98:2 ratio appeared iridescent green upon reflection, similar to the (cracked, crystalline) templates derived from 250 nm sphere dispersion. However, all of the iridescent samples made had been severely cracked, due to the anisotropic shrinkage of the template caused by the high degree of crystalline order. The effect of introducing a small number of 110 nm spheres was to provide a distribution of point defect sites. These defects break the crystalline symmetry and cause a relaxing of the overall structure such that no cracking occurs upon drying, even though the spheres between the off-sized defects appear perfectly close-packed. It is this local ordering that gives rise to the green iridescence. Both the 80:20 and 98:2 templates were also well suited for use in tin deposition. Porous metal films from templates made prepared in the 98:2 ratio are especially well suited for theoretical and experimental modeling due to the high degree of local order as well as the relatively uniform pore size.

EXAMPLE 3

"Painting" Template Formation

A disadvantage of the vertical deposition method is that only a relatively small fraction of the polystyrene spheres used to prepare each dispersion actually contributes to the film. The formation of aggregated particles precludes the reuse of these slurries. Also, templates obtained by this method are generally very thin (less than 3 μm). Thicker templates that lead to thicker porous tin films are desirable in the fabrication of commercially useful battery anodes (e.g., 20-30 μm). Porous tin films of 3 microns thickness will have anode mass of less than 1 mg, making accurate measurement of anode capacity difficult.

Figure 9A:
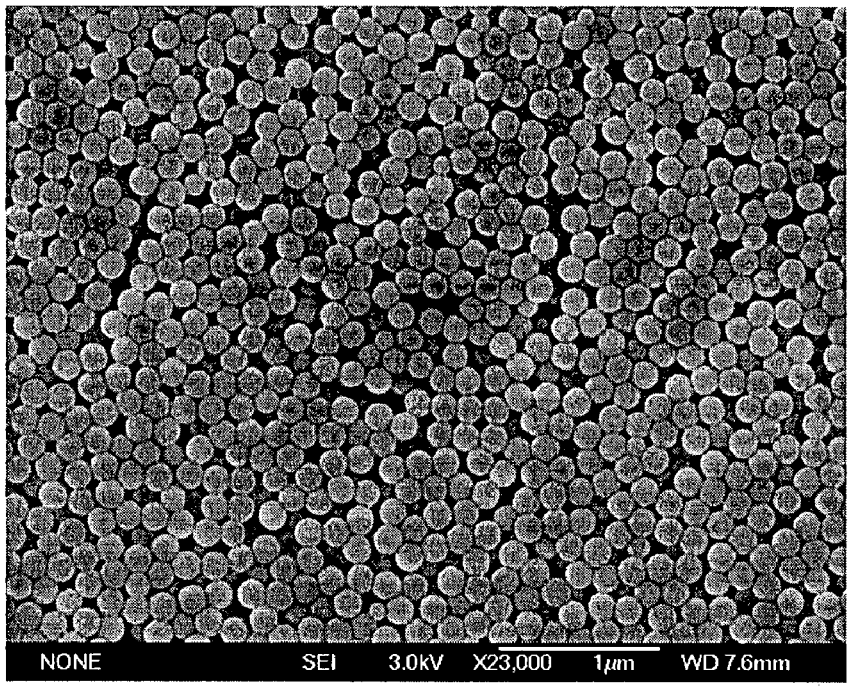
FIGS. 9*a-b* are SEM images of an embodiment of the present invention showing polystyrene sphere templates formed by spreading 20 μL of 8 wt. % dispersion onto a horizontally placed Pt-on-glass substrate.
Figure 9B:
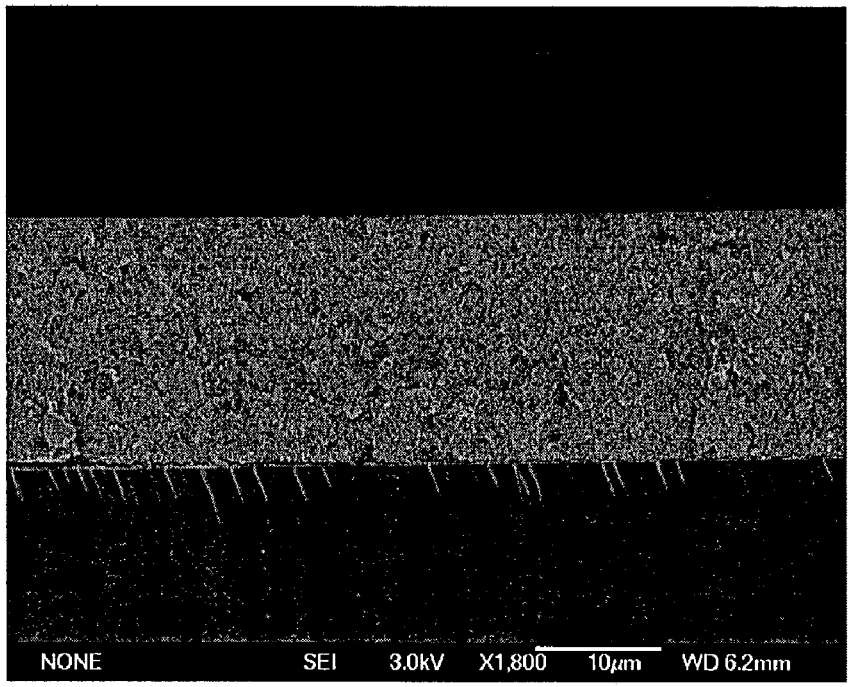
Figure 10:
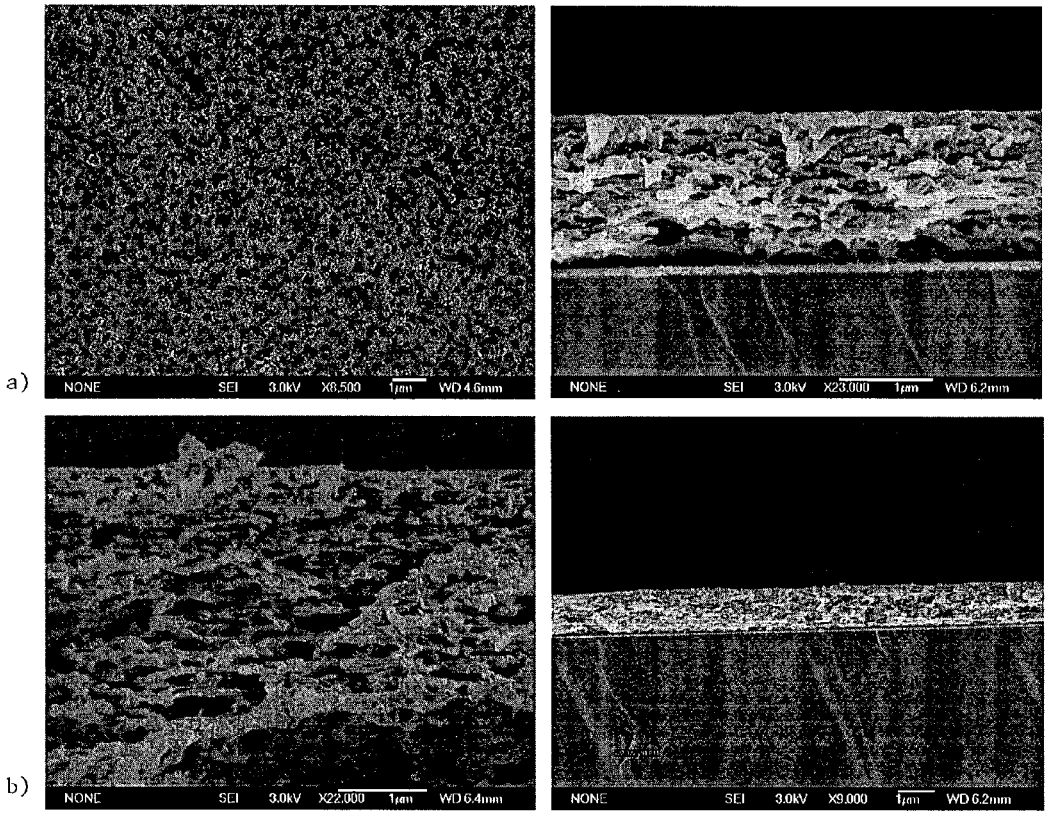
FIGS. 10*a-d* are SEM images of an embodiment of the present invention showing tin metal formed by pulsed electrodeposition through polystyrene templates after removal of template with hot toluene, (FIG. 10*a*) top-view and (FIG. 10*b*) cross-sectional images of tin film grown for about 30 seconds.

For these reasons, the present invention also provides a method of template formation that does not waste large quantities of spheres and that reliably produces thick films of high quality. The method of spreading a small volume of a concentrated sphere dispersion (e.g., about 8 wt. %) onto the horizontal substrate and allowing the liquid phase to evaporate was used. After evaporation, which took only about 30-45 minutes, a uniform film with good adherence to the substrate was obtained (FIGS. 9*a-b*). FIGS. 9*a-b* are SEM images showing polystyrene sphere templates formed by spreading 20 μL of 8 wt. % dispersion onto a horizontally placed Pt-on-glass substrate: (FIG. 9*a*) top-view and (FIG. 9*b*) cross-sectional view. This "painting" technique has the advantages of producing templates with greater speed and reliability, greater thickness, and without wasting microspheres.

The templates produced are typically about 12-20 μm thick, but the thickness may be adjusted by the concentration and size of the spheres and by the amount of dispersion initially contained above the substrate. The same general phenomena arising from high polydispersity and mixtures of different sphere populations that were observed using the vertical deposition method were also observed with the spreading or "painting" technique.

EXAMPLE 4

Formation of Porous Tin Through Vertically Deposited Template

Platinum-on-glass conductive substrates for use in sphere array and tin deposition experiments were prepared as described previously. Polystyrene sphere arrays were prepared by the vertical deposition method. Polystyrene spheres (having an average diameter of about 260 nm) with positively charged surface groups were obtained from Bangs Labs, Inc. and were diluted with DI water for use in template film depositions. Template films were typically prepared from about 0.2% w/w dispersions at 55° C., in which depositions were complete within 2 days using 1 $cm^2$ substrates.

Electrochemical depositions were performed using a EG&G 273A potentiostat/galvanostat, which was remotely controlled by a PC through the use of a GPIB interface and Labview® software. Tin was electroplated from two separate baths: tin tetrafluoroborate and tin sulfate. The composition of the aqueous tin tetrafluoroborate bath was as follows: 100 g/L $Sn(BF_4)_2$, 80 g/L $HBF_4$, 12 g/L $H_3BO_3$, 8.0 mL/L formaldehyde, 0.20 g/L benzylidene acetone, 0.20 g/L 4-aminophenol (See reference 56). To prepare the tin sulfate bath, solid tin sulfate was dissolved in 0.60 M $H_2SO_4$ and stirred for 30 minutes. To the resulting cloudy solution was added 1 g/L activated carbon, (See reference 57) followed by stirring for 30 min. and vacuum filtration to yield a clear, colorless solution.

4-hydroxybenzenesulfonic acid and p-cresol was added to this solution to the following overall composition: 0.15 M $SnSO_4$, 0.60 M $H_2SO_4$, 0.28 M 4-hydroxybenzenesulfonic acid, 0.055 M p-cresol 15. In addition, nonionic triblock copolymer Pluronic L64 was added to some solutions for the purpose of hindering dendrite formation. {TFB bath} After potentiostatic deposition on templated substrates, the PS was dissolved by placing the substrates in about 15 mL of toluene and soaking for 1-2 days.

Potentiostatic depositions were performed from both baths, on bare Pt-on-glass substrates, and on substrates containing polystyrene sphere arrays. The results are shown in FIG. 5*b*, which contains SEM images of submicron porous tin obtained after dissolution of the PS template. The pore structure is disordered, as expected from the disordered template (FIG. 5*a*), yet crack-free regions more than several hundred microns across are observed. Pores in this material range from about 50-250 nm in diameter, which satisfies the structural needs of high surface areas and low diffusion distances through the metal for use as a high-performance lithium-ion anode. In addition, the presence of a disordered porous tin structure ultimately resulted in a greater volume fraction of tin as compared with the "inverse opal" structure (face-centered cubic spherical pore structure), which is expected to contribute an enhanced volumetric capacity.

EXAMPLE 5

Formation of Porous Tin Through "Painted" Template

Tin was electrodeposited in the presence of templates prepared by the simple "painting" procedure described above. A tin sulfate bath was used as described previously (0.15 M $SnSO_4$, 0.60 M $H_2SO_4$) (See reference 1). Polystyrene templates were dissolved in toluene after the tin electrodeposition. Potentiostatic deposition of tin at potentials of −450 mV vs Ag/AgCl produced grains of partially porous tin, separated by regions of bare Pt. Each tin particle appeared "dimpled" on the surface, which is evidence of the presence of microspheres. However, the metal structure did not appear to represent the desired high-porosity inverse of the polystyrene.

Significant morphological improvements in the structure of electrodeposited tin, including smaller grain size reduction and greater throwing power, were obtained through the use of pulsed electroplating instead of using direct current. Porous tin films were deposited for 30 seconds and for 2 minutes using the same plating bath composition but with a deposition pulse of −1.2 V for 75 ms followed by 925 ms rest at −0.44 V (vs. Ag/AgCl). Using the pulsed deposition, the present invention provides a significant morphological improvement in the tin as compared to the direct current. Rather than using room temperature toluene to dissolve the PS spheres, some samples were immersed in toluene inside sealed bottles and heated to 105° C. overnight. Hot toluene was used in order to insure complete dissolution of all polystyrene. FIGS. 10*a-d* are SEM images showing tin metal formed by pulsed electrodeposition through polystyrene templates after removal of template with hot toluene, (FIG. 10*a*) top-view and (FIG. 10*b*) cross-sectional images of tin film grown for about 30 seconds; and (FIG. 10*c* and FIG. 10*d*) cross-sectional images of tin film grown for about 2 minutes.

The present invention thus creates submicron porous metal electrodes with designed morphologies. The porosity provides a high surface area of interface between the anode and the electrolyte, as well as a significant free volume in which the lithium-tin alloy can expand. Additionally, if diffusion distances in the metal are limited to the submicron size scale then the electrochemical insertion and extraction of lithium from tin occur more homogeneously. Phase separation that leads to anode "pulverization" is circumvented.

The methods of the present invention for fabricating intentionally disordered templates have made possible the creation of uniform templated films over much wider areas than are obtained using crystalline arrays of sub-micron sized spheres. The greater power of this modification is that it can still be used in the myriad of porous material syntheses that have already been demonstrated for crystalline close-packed sphere arrays (See references 48, 58, 59). Examples include the synthesis of electrodeposited pure metals (See references 44 and 60), alloys and intermetallic compounds by salt precipitation and thermal conversion (See reference 61), sol-gel derived oxides (See references 51-54, 62, 63), insulating (See reference 50) and conducting organic polymers (See references 64, 65), non-tin group-14 elements including Si (See reference 66) and Ge (See reference 67), and glassy or graphitic carbons (See reference 68). The prevailing paradigm of most materials synthesis researchers using submicron spheres is to create perfectly ordered sphere templates (e.g. for photonic crystals).

The same template technology can be extended to the fabrication of other electrode systems. Submicron porous tin metal is an example of a nanoscale active material, but there are many other attractive systems such as active-active and active-inactive composites. The templating techniques described herein can be merged with existing processes for electrodepositing other lithium active metals and alloys. The principles of electrochemically depositing alloys is well understood (See reference 69) and has been demonstrated for many tin-based alloys such as Sb—Sn (See reference 21), Cu—Sn (See reference 70), Sb—Cu—Sn (See reference 32), Pb—Sn (See reference 71), Sn—Se (See reference 72), Bi—Pb—Cd—Sn (See reference 73), Al—Sn (See reference 74), Pb—Sn (See reference 75), Co—Sn (See reference 76), Au—Sn (See reference 77), Zn—Sn (See reference 78), and many others.

The templates of the present invention can be used to create submicron porous films of other promising metals such as Al, Si, Ge, Pb and alloys such as Sb—I, Sb—Sn, Ni—Sn, Cu—Sn, Al—Sn, Al—Mn, Al—Be, and Al—Ni. Each system will exhibit its own lithium ion conductivity swelling characteristics with the insertion of lithium, and our template formation techniques provide.

In addition to metals and alloy electrode configurations, the present invention can be used to strategically design and synthesize metal-carbon composite anode materials. Several promising examples of these have appeared in recent literature for the cases of Sn-graphite (See references 19, 20, 23, 79), Si-graphite (See reference 14, 20), Sb-graphite (See reference 20), and Sn—Sb—Cu-graphite (See reference 32).

The following references are herein incorporated by reference:

1. R. A. Huggins, "Lithium alloy negative electrodes", J. Power Sources 1999, 81-82:13-19.
2. B. B. Owens, W. H. Smyrl, and J. J. Xu, "R&D on lithium batteries in the USA:high-energy electrode materials", J. Power Sources 1999, 81-82:150-155.
3. S. Megahed and B. Scrosati, "Lithium-ion rechargeable batteries", J. Power Sources 1994, 51:79-104.
4. K. Brandt, "The historical development of secondary lithium batteries", Solid State Ionics 1994, 69:173-183.
5. B. Scrosati, "Lithium rocking chair batteries: An old concept?", J. Electrochem. Soc. 1992, 139(10):2776-2781.
6. J.-M. Tarascon and M. Armand, "Issues and challenges facing rechargeable lithium batteries", Nature 2001, 414: 359-367.

7. M. Winter and J. O. Besenhard, "Electrochemical lithiation of tin and tin-based intermetallics and composites", Electrochem. Acta 1999, 45:31-50.
8. M. Winter, J. O. Besenhard, M. E. Spahr, and P. Novak, "Insertion electrode materials for rechargeable lithium batteries", Adv. Mater. 1998, 10(10):725-763.
9. A. N. Dey, "Electrochemical alloying of lithium in organic electrolytes", J. Electrochem. Soc. 1971, 118(10):1547-1549.
10. T. Nagaura and K. Tozawa, "Lithium ion rechargeable battery", Prog. Batteries Sol. Cells 1990, 9:209-17.
11. S. Yata, H. Kinoshita, M. Komori, N. Ando, T. Kashiwamura, T. Harada, K. Tanaka, and T. Yamabe, "Structure and properties of deeply Li-doped polyacenic semiconductor materials beyond C6Li stage", Synth. Met. 1994, 62:153-158.
12. Y. Idota, T. Kubota, A. Matsufuji, Y. Maekawa, and T. Miyasaka, "Tin-based amorphous oxide: a high capacity lithium-ion-storage material", Science 1997, 276(5317): 1395-1397.
13. I. A. Courtney and J. R. Dahn, "Key factors in controlling the reversibility of the reaction of lithium with SnO2 and Sn2BPO6 glass", J. Electrochem. Soc. 1997, 144(9):2943-2948.
14. H. Li, X. Huang, L. Chen, Z. Wu, and Y. Liang, "A high capacity nano-Si composite anode material for lithium rechargeable batteries", Electrochem Solid State Lett. 1999, 2(11):547-549.
15. A. H. Whitehead, J. M. Elliott, and J. R. Owen, "Nanostructured tin for use as a negative electrode material in Li-ion batteries", J. Power Sources 1999, 81-82:33-38.
16. O. Crosnier, X. Devaux, T. Brousse, P. Fragnaud, and D. M. Schleich, "Influence of particle size and matrix in 'metal' anodes for Li-ion cells" J. Power Sources 2001, 97-98:188-190.
17. Y. S. Fungand D. R. Zhu, "Electrodeposition of tin coating as negative electrode material for lithium-ion battery in room temperature molten salt", J. Electrochem. Soc. 2002, 149(3):A319-A324.
18. N. Tamura, R. Ohshita, M. Fujimoto, S. Fujitani, M. Kamino, and I. Yonezu, "Study on the anode behavior of Sn and Sn—Cu alloy thin film electrodes", J. Power Sources 2002, 107:48-55.
19. M. Egashira, H. Takatsuji, S. Okada, and J. Yamaki, "Properties of containing Sn nanoparticles activated carbon fiber for a negative electrode in lithium batteries", J. Power Sources 2002, 107:56-60.
20. H. Li, L. Shi, Q. Wang, L. Chen, and X. Huang, "Nanoalloy anode for lithium ion batteries", Solid State Ionics 2002, 148:247-258.
21. J. Yang, M. Winter, and J. O. Besenhard, "Small particle size multiphase Li-alloy anodes for lithium-ion-batteries", Solid State Ionics 1996, 90:281-287.
22. H. Li, G. Zhu, X. Huang, and L. Chen, "Synthesis and electrochemical performance of dendrite-like nanosized SnSb alloy formed by coprecipitation in alcohol solution at low temperature", J. Mater. Chem. 2000, 10:693-696.
23. G. X. Wang, J.-H. Ahn, M. J. Lindsay, L. Sun, D. H. Bradhurst, S. X. Dou, and H. K. Liu, "Graphite-tin composites as anode materials for lithium-ion batteries", J. Power Sources 2001, 97-98:211-215.
24. I. Rom, M. Wachtler, I. Papst, M. Schmied, J. O. Besenhard, F. Hofer, and M. Winter, "Electron microscopical characterization of Sn/SnSb composite electrodes for lithium-ion batteries", Solid State Ionics 2001, 143:329-336.
25. M. Wachtler, M. Winter, and J. Besenhard, "Anodic materials for rechargeable Li-batteries", J. Power Sources 2002, 105:151-160.
26. S. D. Han, S. Y. Huang, G. Campet, S. H. Pulcinnelli, and C. V. Santilli, "Reversible electrochemical insertion of lithium in fine grained polycrystalline powders of SnO2", Active and Passive Elec. Comp. 1995, 18:61-68.
27. I. A. Courtney and J. R. Dahn, "Electrochemical and in situ X-ray diffraction studies of the reaction of lithium with tin oxide composites", J. Electrochem. Soc. 1997, 144(6): 2045-2052.
28. J. S. Sakamoto, C. K. Huang, S. Surampudi, M. Smart, and J. Wolfenstine, "The effects of particle size on SnO electrode performance in lithium-ion cells", Materials Letters 1998, 33:327-329.
29. L. Y. Beaulieu, D. Larcher, R. A. Dunlap, and J. R. Dahn, "Reaction of Li with grain boundary atoms in nanostructured compounds", J. Electrochem. Soc. 2000, 147(9): 3206-3212.
30. G. X. Wang, L. Sun, D. H. Bradhurst, S. Zhong, S. X. Dou, and H. K. Liu, "Innovative nanosize lithium storage alloys with silica as active center", J. Power Sources 2000, 88:278-281.
31. N. Li, C. R. Martin, and B. Scrosati, "Nanomaterial-based Li-ion battery electrodes", J. Power Sources 2001, 97-98: 240-243.
32. A. Ulus, Y. Rosenberg, L. Burstein, and E. Peled, "Tin alloy-graphite composite anode for lithium-ion batteries", J. Electrochem. Soc. 2002, 149(5):A635-A643.
33. J. Wolfenstine, S. Campos, D. Foster, J. read, and W. K. Behl, "Nano-scale Cu6Sn5 anodes", J. Power Sources 2002, 109:230-233.
34. D. G. Kim, H. Kim, H.-J. Sohn, and T. Kang, "Nano-sized Sn—Cu—B alloy anode prepared by chemical reduction for secondary lithium batteries", J. Power Sources 2002, 104:221-225.
35. G. R. Goward, L. F. Nazar, and W. P. Power, "Electrochemical and multinuclear solid-state NMR studies of tin composite oxide glasses as anodes for Li ion batteries", J. Mater. Chem. 2000, 10:1241-1249.
36. O. Mao, R. L. Turner, I. A. Courtney, B. D. Fredericksen, M. I. Buckett, L. J. Krause, and J. R. Dahn, "Active/inactive nanocomposites as anodes for Li-ion batteries", Electrochemical and Solid State Letters 1999, 2(1):3-5.
37. W. Schwarzacher, O. I. Kasyutich, P. R. Evans, M. G. Darbyshire, G. Yi, V. M. Fedosyuk, F. Rousseaux, E. Cambril, and D. Decanini, "Metal nanostructures prepared by template electrodeposition", J. Magnetism and Magnetic Mater. 1999, 198-199:185-190.
38. L. Piraux, S. Dubois, J. L. Duvail, K. Ounadjela, and A. Fert, "Arrays of nanowires of magnetic metals and multilayers: Perpendicular GMR and magnetic properties", J. Magnetism and Magnetic Mater. 1997, 175:127-136.
39. J. M. Elliott, G. S. Attard, P. N. Bartlett, N. R. B. Coleman, D. A. S. Merckel, and J. R. Owen, "Nanostructured platinum (HI-ePt) films: Effects of electrodeposition conditions on film properties", Chem. Mater. 1999, 11:3602-3609.
40. G. S. Attard, P. N. Bartlett, N. R. B. Coleman, J. M. Elliott, J. R. Owen, and J. H. Wang, "Mesoporous platinum films from lyotropic liquid crystalline phases", Science 1997, 278:838-840.
41. P. N. Bartlett, P. N. Birkin, M. A. Ghanem, P. de Groot, and M. Sawiki, "The electrochemical deposition of nanostructured cobalt films from lyotropic liquid crystalline media", J. Electrochem. Soc. 2001, 148(2):C119-C123.

42. (a) P. V. Braun and P. Wiltzius, "Electrochemically grown photonic crystals", Nature 1999, 402:603-604; (b) P. V. Braun, M. L. Steigerwald, and P. Wiltzius, "Electrochemical process for fabricating article exhibiting substantial three-dimensional order and resultant article", U.S. Pat. No. 6,409,907 B1, Jun. 25, 2002.
43. P. N. Bartlett, P. R. Birkin, and M. A. Ghanem, "Electrochemical deposition of macroporous platinum, palladium and cobalt films using polystyrene latex sphere templates", Chem. Comm. 2000: 1671-1672.
44. P. Jiang, J. Cizeron, J. F. Bertone, and V. L. Colvin, "Preparation of macroporous metal films from colloidal crystals", J. Am. Chem. Soc. 1999, 121:7957-7958.
45. L. K. van Vugt, A. F. van Driel, R. W. Tjerkstra, L. Bechger, W. L. Vos, D. Vanmaekelbergh, and J. J. Kelly, "Macroporous germanium by electrochemical deposition", Chem. Commun. 2002:2054-2055.
46. N. D. Denkov, O. D. Velev, P. A. Kralchevsky, I. B. Ivanov, H. Yoshimura, and K. Nagayama, "Mechanism of formation of two-dimensional crystals from latex particles on substrates", Langmuir 1992, 8:3183-3190.
47. M. Trau, D. A. Saville, I. A. Aksay, "Field-induced layering of colloidal crystals", Science 1996, 272:706-709.
48. O. D. Velev, T. A. Jede, R. F. Lobo, and A. M. Lenhoff, "Porous silica via colloidal crystallization", Nature 1997, 389:447-448.
49. B. T. Holland, C. F. Blanford, and A. Stein, "Synthesis of macroporous minerals with highly ordered three-dimensional arrays of spherical voids", Science 1998, 281:538-540.
50. S. H. Park and Y. Xia, "Macroporous membranes with highly ordered and three-dimensionally interconnected spherical pores", Adv. Mater. 1998, 10(13):1045-1048.
51. P. Yang, T. Deng, D. Zhao, P. Feng, D. Pine, B. F. Chmelka, G. M. Whitesides, and G. D. Stucky, "Hierarchically ordered oxides", Science 1998, 282:2244-2246.
52. J. E. G. J. Wijnhoven and W. L. Vos, "Preparation of photonic crystals made of air spheres in titania", Science 1998, 281:802-804.
53. G. Subramania, K. Constant, R. Biswas, M. M. Sigalas, and K.-M. Ho, "Optical photonic crystals fabricated from colloidal systems", Appl. Phys. Lett. 1999, 74(26):3933-3935.
54. Z. Zhong, Y. Yin, B. Gates, and Y. Xia, "Preparation of mesoscale hollow spheres of TiO2 and SnO2 by templating against crystalline arrays of polystyrene beads", Advanced Mater. 2000, 12(3):206-209.
55. H. Shiho and N. Kawahashi, "Titanium compounds as coatings on polystyrene lattices as hollow spheres", Colloid Polym. Sci. 2000, 278:270-274.
56. J. Yang, M. Winter, J. O Besenhard, "Small particle size multiphase Li-alloy anodes for lithium-ion batteries", Solid State Ionics 1996, 90:281-87.
57. S. Meibuhr, E. Yeager, A. Kozawa, F. Hovorka, "The Electrochemistry of Tin I. Effects of Nonionic Addition Agents on Electrodeposition from Stannous Sulfate Solutions", Journal of the Electrochemical Society 1963, 110: 190-202.
58. Y. Xia, B. Gates, Y. Yin, and Y. Lu, "Monodispersed colloidal spheres: old materials with new applications", Adv. Mater. 2000, 12(10):693-713.
59. A. Stein and R. C. Schroden, "Colloidal crystal templating of three-dimensionally ordered macroporous solids: materials for photonics and beyond", Current Opinion in Solid State and Materials Science 2001, 5:553-564.
60. L. Xu, W. L. Zhou, C. Frommen, R. H. Baughman, A. A. Zakhidov, L. Malkinski, J.-Q. Wang, and J. B. Wiley, "Electrodeposited nickel and gold nanoscale metal meshes with potentially interesting photonic properties", Chem. Commun. 2000, 997-998.
61. H. Yan, C. F. Blanford, B. T. Holland, W. H. Smyrl, and A. Stein, "General synthesis of periodic macroporous solids by templated salt precipitation and chemical conversion", Chem. Mater. 2000, 12:1134-1141.
62. B. T. Holland, C. F. Blanford, T. Do, and A. Stein, "Synthesis of highly ordered, three-macroporous structures of amorphous or crystalline inorganic oxides, phosphates, and hybrid composites", Chem. Mater. 1999, 11:795-805.
63. B. Gates, Y. Yin, and Y. Xia, "Fabrication and characterization of porous membranes with highly ordered three-dimensional periodic structures", Chem. Mater. 1999, 11:2827-2836.
64. T. Sumida, Y. Wada, T. Kitamura, and S. Yanagida, "Electrochemical preparation of macroporous polypyrrole films with regular arrays of interconnected spherical voids", Chem. Commun. 2000, 1613-1614.
65. T. Cassagneau and F. Caruso, "Semiconducting polymer inverse opals prepared by electropolymerization", Adv. Mater. 2002, 14(1):34-38.
66. A. Blanco, E. Chomski, S. Grabtchak, M. Ibisate, S. John, S. W. Leonard, C. Lopez, F. Meseguer, H. Miquez, J. P. Mondia, G. A. Ozin, O. Toader, and H. M. van Driel, "Large scale synthesis of a silicon photonic crystal with a complete three-dimensional bandgap near 1.5 micrometers", Nature 2000, 405:437-440.
67. H. Miquez, F. Meseguer, C. Lopez, M. Holgado, G. Andreasen, A. Mifsud, and V. Formes, "Germanium FCC structure from a colloidal crystal template", Langmuir 2000, 16:4405-4408.
68. A. A. Zakhidov, R. H. Baughman, Z. Iqbal, C. Cui, I. Khayrullin, S. O. Dantas, J. Marti, and V. G. Ralchenko, "Carbon structures with three-dimensional periodicity at optical wavelengths", Science 1998, 282:897-901.
69. M. Paunovic and M. Schlesinger, in Fundamentals of Electrochemical Deposition, John Wiley & Sons, Inc., New York, 1998, Chapter 11.
70. I. A. Carlos, C. A. C. Souza, E. M. J. A. Pallone, R. H. P. Francisco, V. Cardoso, and B. S. Lima-Neto, "Effect of tartrate on the morphological characteristics of the copper-tin electrodeposits from a noncyanide acid bath", J. Appl. Electrochem. 2000, 30:987-994.
71. P. A. Kohl, "The high-speed electrodeposition of Sn/Pb alloys", J. Electrochem. Soc. 1982, 129(6):1196-1201.
72. B. Subramanian. T. Mahalingam, C. Sanjeeveraja, M. Jayachandran, and M. J. Chockalingam, "Electrodeposition of Sn, Se, SnSe and the mechanical properties of SnSe films", Thin Solid Films 1999:119-124.
73. M. H. Chapeau-Poinso, J. Bouteillon, and J. C. Poignet, "Cathodic codeposition of alloyed materials for use in lithium battery negative electrodes", J. Appl. Electrochem. 1994, 24:66-71.
74. V. V. Kuznetsov, V. P. Grigor'ev, L. M. Skibina, and N. V. Shurupova, "Kinetics of aluminum-tin alloy electrodeposition from aromatic hydrocarbin-based electrolytes", Elektrokhimiya 1982, 18(1):80-85.
75. T. M. Tam, "Electrodeposition kinetics for tin, lead, and tin-lead fluoroborate plating solutions", J. Electrochem. Soc. 1986, 133(9):1792-1796.
76. A. Survila, Z. Mockus, R. Juskenas, and V. Jasulaitiene, "Electrodeposition of Sn and Co coatings from citrate solutions", J. Appl. Electrochem. 2001, 31:1109-1116.

77. J. Doesburg and D. G. Ivey, "Co-deposition of gold-tin alloys from a non-cyanide solution", Plating and Surface Finishing 2001, 88(4):78-83.

78. O. A. Ashiru and J. Shirokoff, "Electrodeposition and characterization of tin-zinc alloy coatings", Appl. Surf. Sci. 1996, 103(2):159-169.

79. B. Veeraraghavan, A. Durairajan, B. Haran, B. Popov, and R. Guidotti, "Study of Sn-coated graphite as anode material for secondary lithium-ion battery", J. Electrochem. Soc. 2002, 149(6):A675-A681.

These and other changes and modifications are intended to be included within the scope of the invention. While for the sake of clarity and ease of description, several specific embodiments of the invention have been described; the scope of the invention is intended to be measured by the claims as set forth below. The description is not intended to be exhaustive or to limit the invention to the form disclosed. Other variations of the invention will be apparent in light of the disclosure and practice of the invention to one of ordinary skill in the art to which the invention applies.

The invention claimed is:

1. A process for colloidal sphere-templated electrodeposition of a porous metal structure at least partially disordered, comprising:

a) providing an electrode substrate;

b) applying a dispersion onto the surface of the substrate, said dispersion being a liquid phase suspension of colloidal particles comprising of particles that are substantially spherical in shape and have a standard deviation in sphere diameter of greater than about 5%;

c) removing the liquid phase to form a sacrificial template comprising an array of close packed colloidal spheres defining an interstitial volume;

d) electrodepositing a metal plating solution onto the array to form a metallic replica of the array interstitial volume having a pore distribution corresponding to the spheres; and e) removing the sacrificial template to form said porous metal structure.

2. The process of claim 1, wherein the colloidal spheres are polystyrene, polymethylmethacrylate, surface-functionalized polymer, or silica.

3. The process of claim 1, wherein said assembly of spheres is by liquid evaporation or centrifugation.

4. The process of claim 1, wherein the sphere assembly is removed by dissolution with a solvent or an acid.

5. The process of claim 1, wherein the metal is Sn, Al, Si, Ge, Pb; Sb—Sn; Cu—Sn; Sb—Cu—Sn; PbSn; Sn—Se; Bi—Pb—Cd—Sn; Al—Sn; Pb—Sn; Co—Sn; Au—Sn; Zn—Sn; Sb—I; Ni—Sn; Al—Mn; Al—Be; or Al—Ni.

6. The process of claim 1, wherein the metal is Sn.

7. The process of claim 1 wherein the spheres are selected to have a mean diameter within the range of about 10 nm, to about 1000 nm.

8. The process of claim 1, wherein the colloidal spheres have a predetermined size.

9. The process of claim 1, further comprising: after step (c), heating the template below the melting point of the colloidal particles.

10. The process of claim 1, wherein the applying step, the dispersion comprises a mixing of two or more populations of differently sized spheres.

11. The porous metal film of claim 10.

12. A process for colloidal sphere-templated electrodeposition of a porous metal structure at least partially disordered for use in an electrode, comprising:

a) providing an electrode substrate;

b) applying a thin layer of tin onto the electrode substrate;

c) applying a dispersion onto the surface of the substrate, said dispersion being a liquid phase suspension of colloidal particles substantially spherical in shape and have a standard deviation in sphere diameter of greater than about 5%;

d) removing the liquid phase to form a sacrificial template comprising an array of close packed colloidal spheres defining an interstitial volume, wherein the colloidal spheres are polystyrene, polymethylmethacrylate, surface-functionalized polymer, or silica;

e) electrodepositing a metal plating solution onto the array to form a metallic replica of the array interstitial volume having a pore distribution corresponding to the spheres; and f) removing the sacrificial template to form said porous metal structure.

13. The process of claim 12, further comprising: after step (d), heating the template below the melting point of the colloidal particles.

14. A process for colloidal sphere-templated electrodeposition of a porous tin or tin alloy structure at least partially disordered, comprising:

a) providing an electrode substrate;

b) applying a dispersion onto the surface of the substrate, said dispersion being a liquid phase suspension of colloidal particles comprising of particles that are substantially spherical in shape and have a standard deviation in sphere diameter of greater than about 5%;

c) removing the liquid phase to form a sacrificial template comprising an array of close packed colloidal spheres defining an interstitial volume, wherein the colloidal spheres are polstyrene, polylmethylmethacrylate, surface-functionalized polymer, or silica;

d) electrodepositing a metal plating solution onto the array to form a metallic replica of the array interstitial volume having a pore distribution corresponding to the spheres; and e) removing the sacrificial template to form said porous metal structure.

15. The process of claim 14, further comprising: after step (c), heating the template below the melting point of the colloidal particles.

16. A process for the formation of a template, comprising:

a) providing an electrode substrate;

b) applying a dispersion onto the surface of the substrate, said dispersion being a liquid phase suspension of colloidal particles comprising of particles that are substantially spherical in shape and have a standard deviation in sphere diameter of greater than about 5%; and c) removing the liquid phase to form a sacrificial template comprising an array of close packed colloidal spheres defining an interstitial volume.

17. The template formed by the process of claim 16.

18. A porous metal or metal oxide film having pores of mean diameter within the range of about 10 nm to about 1000 nm, with a deviation from the mean of no more than about 5%, wherein said pores are connected to each other.

19. A porous metal film having pores of mean diameter within the range of about 10 nm to about 1000 nm, with a deviation from the mean of more than about 5%, wherein said pores are connected to each other.

20. A porous electrode film having pores of mean diameter within the range of about 10 nm to about 1000 nm, with a deviation from the mean of more than about 5%, wherein said pores are connected to each other.

21. A porous Sn film having pores of mean diameter within the range of about 10 nm to about 1000 nm, with a deviation from the mean of more than about 5%, wherein said pores are connected to each other.

22. The porous metal film formed by the process of claim 1.

* * * * *